US009850759B2

(12) United States Patent
Bonin et al.

(10) Patent No.: US 9,850,759 B2
(45) Date of Patent: Dec. 26, 2017

(54) CIRCULATING PISTON ENGINE

(71) Applicant: WB Development Company LLC, Marlborough, MA (US)

(72) Inventors: Walter T. Bonin, Marlborough, MA (US); Glenn A. Jordan, Harvard, MA (US)

(73) Assignee: WB Development Company LLC, Marlborough, MA (US)

( * ) Notice: Subject to any disclaimer, the term of this patent is extended or adjusted under 35 U.S.C. 154(b) by 0 days.

(21) Appl. No.: 14/143,995

(22) Filed: Dec. 30, 2013

(65) Prior Publication Data

US 2014/0182534 A1 Jul. 3, 2014

Related U.S. Application Data

(60) Provisional application No. 61/748,553, filed on Jan. 3, 2013.

(51) Int. Cl.

| | |
|---|---|
| ***F02B 75/04*** | (2006.01) |
| ***F01C 1/46*** | (2006.01) |
| ***F01C 3/02*** | (2006.01) |
| ***F01C 21/08*** | (2006.01) |
| ***F01C 1/356*** | (2006.01) |

(52) U.S. Cl.

CPC ..... *F01C 1/46* (2013.01); *F01C 1/3568* (2013.01); *F01C 3/02* (2013.01); *F01C 21/0818* (2013.01)

(58) Field of Classification Search

CPC ..... Y02T 10/17; F02B 53/02; F02B 53/00; F02B 2730/01; F02B 2730/03; F01C 3/02

USPC ..... 123/228, 235, 245; 418/33, 111, 139, 418/215; 219/133

See application file for complete search history.

(56) References Cited

U.S. PATENT DOCUMENTS

| | | | |
|---|---|---|---|
| 394,684 | A | 12/1888 | Farmer |
| 645,893 | A | 3/1900 | Dean |
| 919,698 | A | 4/1909 | Crull |
| 1,018,953 | A | 2/1912 | Barnes |
| 1,478,352 | A | 12/1923 | George |
| 1,584,605 | A | 5/1926 | Byron |
| 1,602,018 | A | 10/1926 | Harvey |
| 1,612,785 | A | 12/1926 | La Fleur |

(Continued)

FOREIGN PATENT DOCUMENTS

| | | | |
|---|---|---|---|
| DE | 3403132 | A1 | 8/1985 |
| DE | 3815122 | A1 | 11/1989 |

(Continued)

OTHER PUBLICATIONS

International Search Report dated Sep. 15, 2014 for corresponding International Application No. PCT/US2013/078510 (5 pages).

*Primary Examiner* — Mark Laurenzi
*Assistant Examiner* — Shafiq Mian
(74) *Attorney, Agent, or Firm* — Duquette Law Group, LLC

(57) ABSTRACT

An engine, such as a circulating piston engine, includes a housing that defines an annular bore, a piston assembly, and a valve. The piston assembly is disposed within the annular bore and is configured to be coupled to a drive mechanism. The valve is configured to be intermittently disposed within the annular bore to define a combustion chamber relative to the piston assembly.

19 Claims, 14 Drawing Sheets

(56) References Cited

U.S. PATENT DOCUMENTS 1,817,663 A 8/1931 Ashworth
1,918,174 A 7/1933 Bergrren
2,069,557 A * 2/1937 Policansky ..... F01C 1/3568 123/202
2,109,185 A 2/1938 Thompson
2,310,653 A * 2/1943 Reynolds ..... F02B 53/00 123/244
2,371,514 A 3/1945 Gold et al.
2,409,141 A * 10/1946 Margolis ..... 123/228
2,583,633 A * 1/1952 Cronin ..... 123/235
2,674,234 A * 4/1954 Riggle ..... F01C 1/3562 123/235
2,779,318 A 1/1957 Strader
2,983,264 A * 5/1961 Herrmann ..... F01B 3/04 123/56.8
3,287,903 A * 11/1966 Wickman ..... 60/39.163
3,511,131 A 5/1970 Kress
3,521,533 A 7/1970 Van Avermaete
3,799,035 A 3/1974 Lamm
3,897,758 A * 8/1975 Humiston ..... F01C 1/3566 123/205
3,991,728 A 11/1976 Vittert
4,038,949 A 8/1977 Farris
4,078,529 A 3/1978 Warwick
4,084,555 A 4/1978 Outlaw
4,566,411 A 1/1986 Summerlin
4,738,235 A * 4/1988 Silvoza ..... F01C 1/067 123/245
5,433,176 A 7/1995 Blount
5,551,853 A * 9/1996 Cherry ..... F01C 1/3448 418/137
5,729,978 A * 3/1998 Hiereth ..... F02B 37/105 60/607
5,794,583 A * 8/1998 Ichieda ..... F01C 1/3448 123/244
5,944,493 A 8/1999 Albertin et al.
6,167,850 B1 1/2001 Blount
6,253,717 B1 7/2001 Doyle
6,536,383 B2 3/2003 Santiyanont
6,651,609 B2 * 11/2003 Nagata ..... F01C 1/32 123/243
6,769,384 B2 8/2004 Dougherty
6,779,494 B1 * 8/2004 Aswani ..... F01B 3/04 123/56.1
7,082,932 B1 * 8/2006 Crane ..... F02D 23/00 123/435
7,341,041 B2 3/2008 Pekau
7,398,757 B2 7/2008 Bowley
7,451,726 B1 11/2008 Sporea
7,520,251 B2 4/2009 Saari
7,721,685 B2 * 5/2010 Page ..... F02B 53/02 123/43 A
7,757,658 B2 7/2010 Nagata et al.
8,151,759 B2 4/2012 Wright
2002/0162540 A1 11/2002 Matthews et al.
2005/0217636 A1 * 10/2005 Turner ..... 123/245
2006/0027547 A1 * 2/2006 Silvestro ..... 219/133
2008/0050258 A1 * 2/2008 Wright ..... 418/33
2008/0087252 A1 4/2008 Sorrels
2008/0105224 A1 * 5/2008 Kubes ..... F01B 3/0005 123/56.1
2009/0050083 A1 * 2/2009 Decuir, Jr. ..... F01L 1/053 123/90.6
2010/0199666 A1 * 8/2010 VanDyne ..... F02B 37/105 60/605.2

FOREIGN PATENT DOCUMENTS

DE 102007020337 A1 11/2008
FR 2166808 A5 8/1973
JP 05-059960 A 3/1993
JP 07-011972 A 1/1995
JP 8-508331 A2 9/1996
JP 10205345 A 8/1998
JP 2002004873 A 1/2002
JP 2008500492 A2 1/2008
JP 2011163414 A 8/2011
JP 2011529158 A 12/2011
WO 03025369 A1 3/2003
WO 2005038198 A1 4/2005
WO 2008024505 A2 2/2008
WO 2008108743 A1 9/2008

* cited by examiner

CIRCULATING PISTON ENGINE

RELATED APPLICATION

This patent application claims the benefit of U.S. Provisional Application No. 61/748,553, filed on Jan. 3, 2013, entitled, "Circulating Piston Engine," the contents and teachings of which are hereby incorporated by reference in their entirety.

BACKGROUND

Conventional piston engines include multiple cylinder assemblies used to drive a crankshaft. In order to drive the crankshaft, each cylinder assembly requires fuel, such as provided by a fuel pump via a fuel injector. During operation, a spark plug of each cylinder assembly ignites a fuel/air mixture received from the fuel injector and causes the mixture to expand. Expansion of the ignited mixture displaces a piston of the cylinder assembly within a cylinder assembly housing to rotate the crankshaft.

SUMMARY

By contrast to conventional piston engines, embodiments of the present innovation relate to a circulating piston engine. In one arrangement, the circulating piston engine includes a housing that defines an annular bore extending about its outer periphery and a set of pistons disposed within the bore and secured to a drive mechanism or driveshaft. The engine also includes a set of valves that are moveably disposed within the bore, each valve being configured to define a temporary combustion chamber relative to a corresponding piston.

During operation, when disposed in a first position, each valve defines a combustion chamber relative to a corresponding piston, a fuel injector introduces a gas/air mixture into the chamber, and a spark plug ignites the mixture. Combustion of the mixture generates a corresponding force on each piston (e.g., along a direction that is substantially tangential to the annular bore along the direction of rotation of the drive mechanism) and propels the pistons forward within the annular bore. As each piston advances toward a subsequently disposed valve, each of the valves moves to a second position within the annular bore to allow each piston to rotate past the corresponding valve. Next, the engine repositions each valve within the bore to the first position to define the combustion chamber with the corresponding piston and the process begins again. Accordingly, as the set of pistons rotate around the perimeter of the engine, the drive mechanism generates a relatively large torque, such as an average torque of about 4500 ft-lbs. At ignition, the drive mechanism can generate a torque of about 10,000 ft-lbs. These torques are generated by the relatively large moment arm between each piston and the drive mechanism, as well as the 90° direction of the force applied to each piston.

In one arrangement, the annular bore defined by the engine housing has a relatively large circumference. During operation, when divided by the pistons, this results in a relatively long stroke distance utilizing a high percentage of the energy generated by combustion of the fuel/air mixture within the combustion chamber. Additionally, the substantially continuous motion of the pistons within the annular bore reduces the duration of time that each piston is exposed to the heat of combustion, thereby providing the engine with a relatively high thermal efficiency (e.g., relative to crankshaft-based engines). Also, the configuration of the fuel delivery system of the engine allows the fuel to be delivered to the engine in a process that is separate from, but parallel to, the combustion process. This creates, in effect, a single cycle engine where the combustion process is substantially continuous and where the power output of the engine can be increased (e.g., increased to a horsepower of about 685 @800 RPM) relative to conventional engines. Accordingly, the engine configuration results in the delivery of more precise fuel ratios, a more complete combustion of the fuel/air mixture, and shorter times at high temperatures compared to conventional piston engines. This can reduce the amount of contaminants generated by the engine and output as part of the exhaust and can increase the engine's efficiency such as to an efficiency of about 60%.

In one arrangement, embodiments of the innovation relate to an engine, such as a circulating piston engine. The engine includes a housing that defines an annular bore, a piston assembly, and a valve. The piston assembly is disposed within the annular bore and is configured to be coupled to a drive mechanism. The valve is configured to be intermittently disposed within the annular bore to define a combustion chamber relative to the piston assembly.

BRIEF DESCRIPTION OF THE DRAWINGS

The foregoing and other objects, features and advantages will be apparent from the following description of particular embodiments of the innovation, as illustrated in the accompanying drawings in which like reference characters refer to the same parts throughout the different views. The drawings are not necessarily to scale, emphasis instead being placed upon illustrating the principles of various embodiments of the innovation.

DETAILED DESCRIPTION

Embodiments of the present innovation relate to a circulating piston engine. In one arrangement, the circulating piston engine includes a housing that defines an annular bore extending about its outer periphery and a set of pistons disposed within the bore and secured to a drive mechanism or driveshaft. The engine also includes a set of valves that are moveably disposed within the bore, each valve being configured to define a temporary combustion chamber relative to a corresponding piston.

Figure 1:
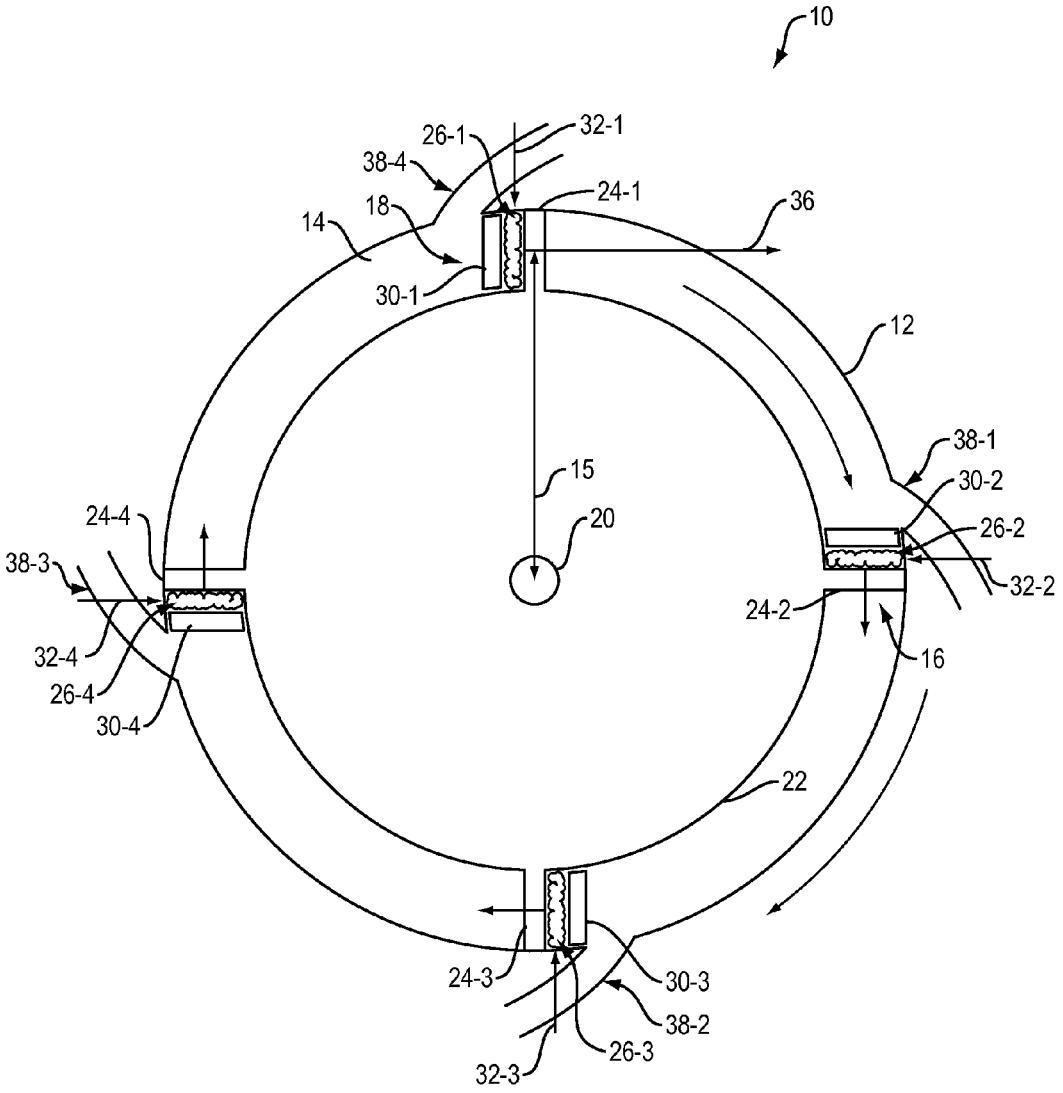
FIG. 1 illustrates an overhead, cross-sectional, schematic view of an engine having a piston assembly disposed in a first position within the housing, according to one arrangement

FIG. 1 illustrates an overhead, cross-sectional, schematic view of a circulating piston engine 10, according to one arrangement. The engine 10 includes a housing 12 that defines an annular channel or bore 14 and that contains a piston assembly 16 and a valve assembly 18.

The annular bore 14 is disposed at an outer periphery of the housing 12. While the annular bore 14 can be configured in a variety of sizes, in one arrangement, the annular bore 14 is configured as having a radius 15 of about twelve inches relative to an axis of rotation 21 of the piston assembly 16. As will be described below, with such a configuration, the relatively large radius 15 of the annular bore 14 disposes the engine combustion chamber at a maximal distance from the axis of rotation 21 and allows the piston assembly to generate a relatively large torque on an associated drive mechanism 20, such as a drive shaft, disposed at the axis of rotation.

The annular bore 14 can be configured with a cross-sectional area having a variety of shapes. For example, with reference to FIG. 2B, in the case where a piston 24 of the piston assembly 16 is configured to define a generally rectangular cross-sectional area 25, the annular bore 14 can also define a corresponding rectangular cross-sectional area 27. In such an arrangement, the cross-sectional area 27 of the annular bore 14 is larger than the cross sectional area 25 of the piston 24 to allow the piston 24 to travel within the annular bore 14 during operation.

Returning to FIG. 1, in the arrangement illustrated, the piston assembly 16 is disposed within the annular bore 14 and is coupled to the drive mechanism 20 via a flywheel 22. While the piston assembly 16 can include any number of individual pistons 24, in the arrangement illustrated, the piston assembly 16 includes four pistons 24-1 through 24-4 disposed about the periphery of the flywheel 22. While the pistons 24 can be disposed at a variety of locations about the periphery of the flywheel 22, in one arrangement, opposing pistons are disposed at an angular orientation of about 180° relative to each other and adjacent pistons disposed at an angular orientation of about 90° relative to each other. For example, as illustrated, the first and third pistons 24-1, 24-3 are disposed on the flywheel 22 at about 180° relative to each other and the second and fourth pistons 24-2, 24-4 are disposed on the flywheel 22 at about 180° relative to each other. Additionally, the first and second pistons 24-1, 24-2 are disposed on the flywheel 22 at a relative angular orientation of about 90°, the second and third pistons 24-2, 24-3 are disposed on the flywheel 22 at a relative angular orientation of about 90°, the third and fourth pistons 24-3, 24-4 are disposed on the flywheel 22 at a relative angular orientation of about 90°, and the fourth and first pistons 24-4, 24-1 are disposed on the flywheel 22 at a relative angular orientation of about 90°.

During operation, the pistons 24 of the piston assembly 16 are configured to rotate within the annular bore 14. As illustrated, the pistons 24 are configured to rotate within the annular bore 14 in a clockwise direction. However, it should be noted that the pistons can rotate within the annular bore 14 in a counterclockwise manner as well. Such rotation causes rotation of the drive mechanism 20.

The valve assembly 18 includes a set of valves 30 configured to define combustion chambers 26 relative to the respective pistons 24 of the piston assembly 16. For example, while the valve assembly 18 can include any number of individual valves 30, in the arrangement illustrated, the valve assembly 18 includes valves 30-1 through 30-4 disposed within the annular bore 14 of the housing 12. While the valves 30 can be disposed at a variety of locations about the periphery of the housing 12, in one arrangement, opposing valves are disposed at an angular orientation of about 180° relative to each other and adjacent valves disposed at an angular orientation of about 90° relative to each other. For example, as illustrated, the first and third valves 30-1, 30-3 are disposed about the periphery of the housing 12 at about 180° relative to each other and the second and fourth valves 30-2, 30-4 are disposed about the periphery of the housing 12 at about 180° relative to each other. Additionally, the first and second valves 30-1, 30-2 are disposed about the periphery of the housing 12 at a relative angular orientation of about 90°, the second and third valves 30-2, 30-3 are disposed about the periphery of the housing 12 at a relative angular orientation of about 90°, the third and fourth valves 30-3, 30-4 are disposed about the periphery of the housing 12 at a relative angular orientation of about 90°, and the fourth and first valves 30-4, 30-1 are disposed about the periphery of the housing 12 at a relative angular orientation of about 90°. In such an arrangement, the relative positioning of the valves 30 of the valve assembly 18 corresponds to the relative positioning of the pistons 24 of the piston assembly 16.

Figure 2A:
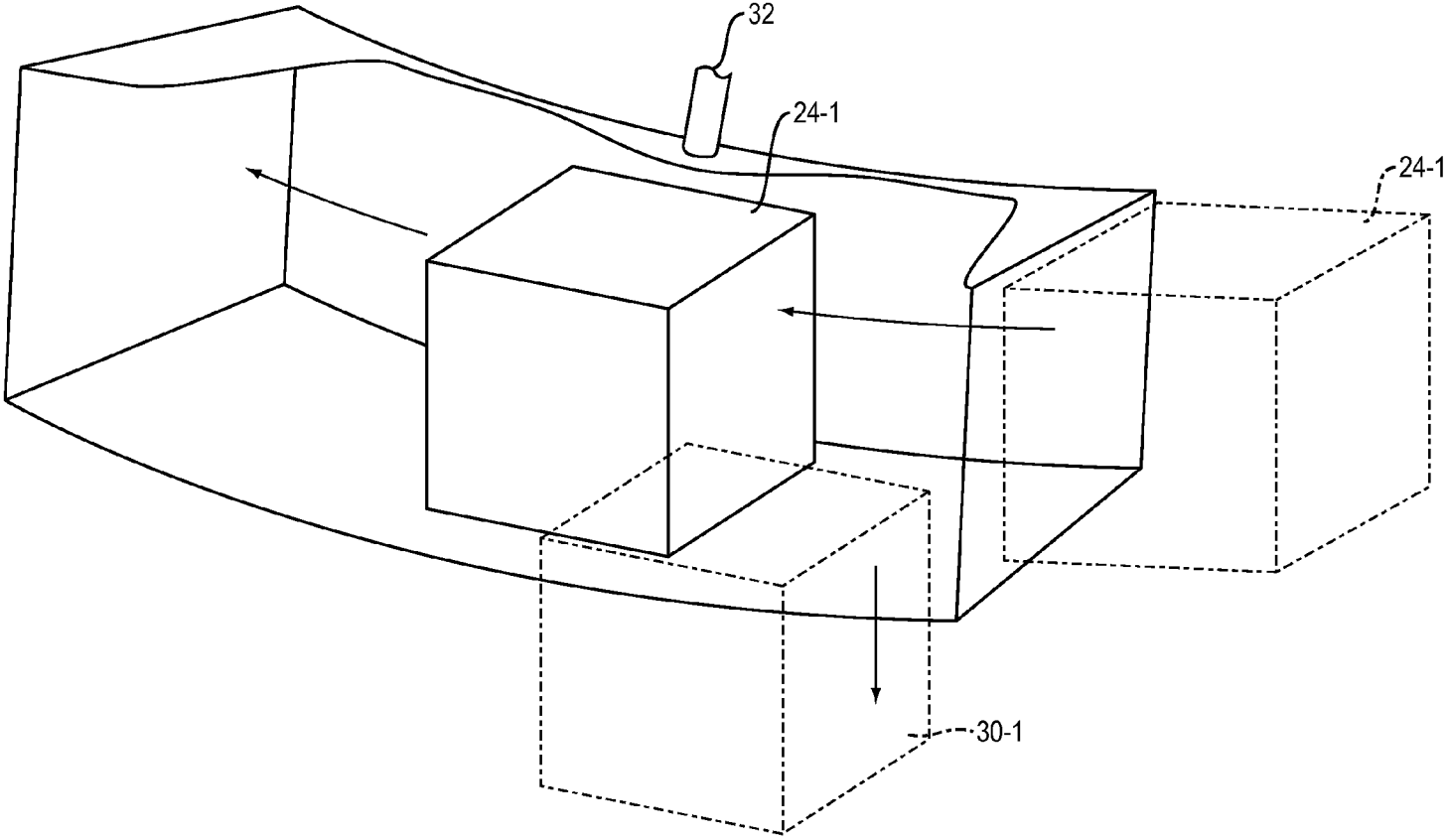
FIG. 2A illustrates a partial sectional view of a portion of an annular bore of FIG. 1, according to one arrangement.
Figure 2B:
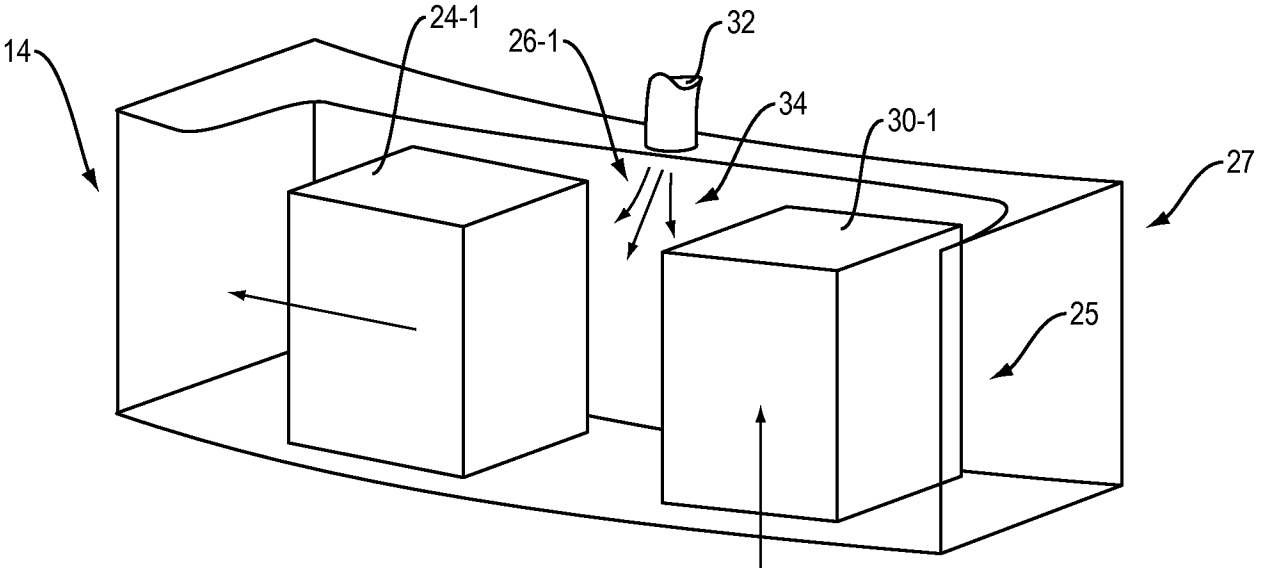
FIG. 2B illustrates a partial sectional view of a portion of the annular bore of FIG. 2A, according to one arrangement.

Each valve 30 of the valve assembly 18 is moveably disposed within the annular bore 14 to create a temporary combustion chamber 26 relative to a corresponding piston 24. For example, during operation, each piston 24 of the piston assembly 16 rotates within the annular bore 14 and toward a valve 30 of the valve assembly 18. Taking piston 24-1 and valve 30-1 as an example, and with reference to FIG. 2A, as the piston 24-1 transitions within the annular bore 14 from a distal position to a proximal position relative to the corresponding valve 30-1, the valve 30-1 is disposed in a first position relative to the annular bore 14. In the first position, the valve 30-1 is at least partially withdrawn from the travel path of the piston 24-1 within the annular bore 14 to allow the piston 24-1 to advance along its travel path. With reference to FIG. 2B, when the piston 24-1 reaches a given location within the annular bore 14 (e.g., once the piston 24-1 has passed the valve 30), the valve 30-1 moves to a second position relative to the annular bore 14 (e.g., to a closed position), such as illustrated. With such positioning, the valve 30-1 defines the combustion chamber 26-1 relative to the piston 24-1 and is configured as a bulkhead against which combustion can work to produce power.

For example, with each valve 30 disposed in a closed position as indicated in FIG. 1, a fuel injector 32 then delivers a fuel-air mixture 34 into the associated combustion chambers 26 which can then be ignited by an ignition device (not shown) such as a spark plug. As the ignition devices ignite the fuel-air mixture 34 in all four of the combustion chambers 26-1 through 26-4 in a substantially simultaneous manner, the expansion of the fuel-air mixture 34 against each valve 30-1 through 30-4 generates a load 36 on each of the corresponding pistons 24-1 through 24-4 to propel each piston 24-1 through 24-4 along the rotational travel path defined by the annular bore 14.

Figure 3:
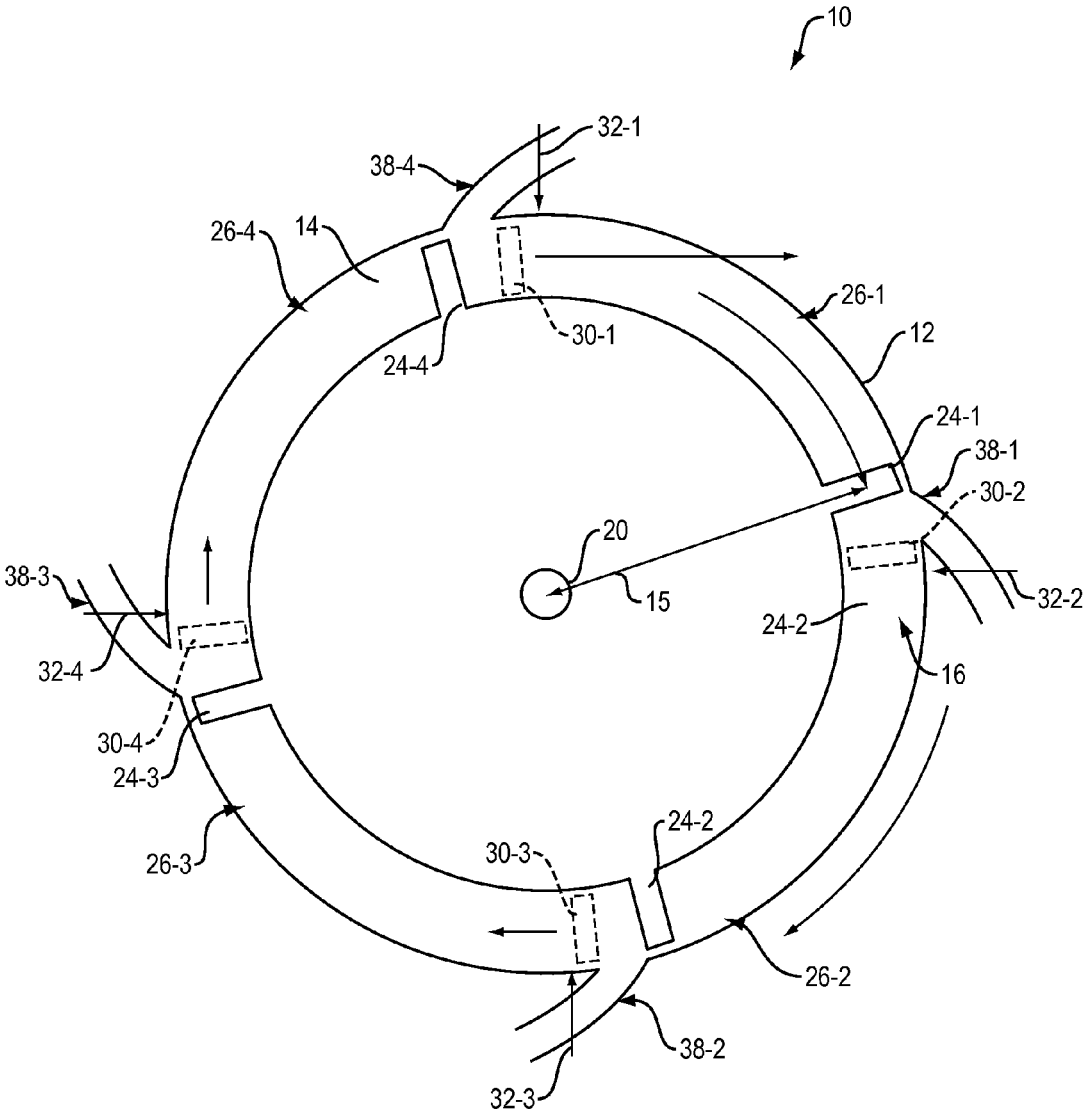
FIG. 3 illustrates an overhead, cross-sectional, schematic view of the engine of FIG. 1 having a piston assembly disposed in a second position within the housing, according to one arrangement.

With reference to FIG. 3, each of the pistons 24-1 through 24-4 travels within the bore 14 along a relatively large stroke distance, such as a distance of between about 12 inches and 15 inches, toward the next valve 30. At a certain point in the bore 14, such as at the end of a stroke length 13 as illustrated in FIG. 1, each piston 24 passes a corresponding exhaust port 38 (i.e., disposed proximal to the subsequent valve 30) which vents the spent gas contained in the chamber 26 to the atmosphere. For example, as piston 24-1 passes the exhaust port 38-1, spent gas contained in the chamber 26-1 between the piston 24-1 and the valve 30-1 can exit the chamber 26-1 via the exhaust port 38-1.

The exhaust ports 38, in one arrangement, are configured as passive ports which are open to the atmosphere and which do not require mechanical components. In one arrangement, each exhaust port 38 is configured as being relatively large to provide efficient exhausting to the engine 10. For example, the stroke distance between the piston 24 and valve 30, such as a stroke distance of between about 12 inches and 15 inches, can form part of each exhaust port 38 to increase the overall length of the port 38.

Additionally, as each piston 24 approaches the subsequently disposed valve 30, each valve 30 moves from the second, closed position (FIGS. 1 and 2B) to the first position (FIGS. 3 and 2A) relative to a corresponding piston 24. For example, as the piston 24-1 approaches the valve 30-2, the valve 30-2 is at least partially withdrawn from the bore 14 to allow the piston 24-1 to move past the valve 30-2. Once each of the pistons 24 have translated to a location distal to the corresponding valves 30, the corresponding valves 30 are moved to the first position and the process begins again. Accordingly, during operation, the engine 10 can generate up to sixteen combustion events per revolution (i.e., each of four pistons 24 experiencing up to four combustion events in a single revolution), thereby causing the piston assembly 16 to rotate the drive mechanism 20.

In use, the pistons 24 and valve assembly 16 are disposed at the outer perimeter of the engine housing 12, such as at distance of about twelve inches from the drive mechanism 20. With the combustion force applied to the pistons 24 along a direction that is tangent to the direction of rotation and perpendicular to the distance 15 from the drive mechanism 20, such combustion force can maximize torque on the drive mechanism 20. Additionally, the relatively long stroke path of the pistons 24, the presence of the exhaust ports 38, and the ability of the engine 10 to customize the number of combustion events generated in the bore 14 can enhance the performance of the engine 10. For example, the engine 10 can produce a relatively large amount of continuous power (e.g., a horsepower of about 685 @800 RPM) with a relatively high torque (e.g., an average torque of about 4500 ft-lbs) and efficiency (e.g., an efficiency of about 60%) relative to conventional engines having an efficiency of about 25-30%.

In one arrangement, the operation of the engine 10 can considerably reduce pollutants compared with current engines. For example, the relatively long stroke distance, among other factors, can reduce unburnt hydrocarbons and carbon monoxide contained in the combustion chamber 26. Oxides of nitrogen should also be reduced since the amount formed during combustion is proportional to temperature and dwell times. The rapid and continuous motion of the piston 24 within the bore 14 can reduce their formation, as dwell times will be reduced.

As indicated above, the engine 10 can generate relatively large amounts of torque (e.g., 15 times the torque generated by conventional engines). In conventional piston engines, complex six-speed (and greater) transmissions are needed to multiply the engine's torque for adequate performance, which add to the weight, expense, and complexity to the transmissions. However, because the engine 10 described above generates a relatively higher amount of torque, the engine requires fewer gear ratios than conventional engines and, hence, utilizes a lighter and less expensive transmission.

It should be noted that the relatively high torque generated by the engine 10 can be managed by adjustment of the combustion events (i.e., the firing sequence of the pistons 30 and detonation mechanisms) within the engine 10. For example, each piston 24 can experience four combustions per revolution such that the entire piston assembly 16 experiences a total of sixteen combustions per revolution. In order to control the power and output torque of the engine 10 as necessary, the engine 10 can fire anywhere from one to sixteen times per revolution. For example, the combustion chambers 26 are arranged around the periphery and can be fired independent from each other. This allows firing of a combustion event from one to sixteen times per revolution to adjust the velocity of the pistons 24 within the annular bore and to adjust the power or output torque generated by the engine 10. Such a configuration of the engine 10 contrasts the use of a throttle in conventional engines, which manages flow of air and is relatively less efficient.

As indicated above, each valve 30 of the valve assembly 18 is moveably disposed within the annular bore to create a temporary combustion chamber 26 relative to a corresponding piston 24. The valve assembly 18 and valves 30 can be configured in a variety of ways to provide such temporary combustion chamber creation. FIGS. 4 through 7 illustrate one arrangement of a valve assembly 118 having a valve 130 configured to reciprocate within the bore 14.

Figure 4:
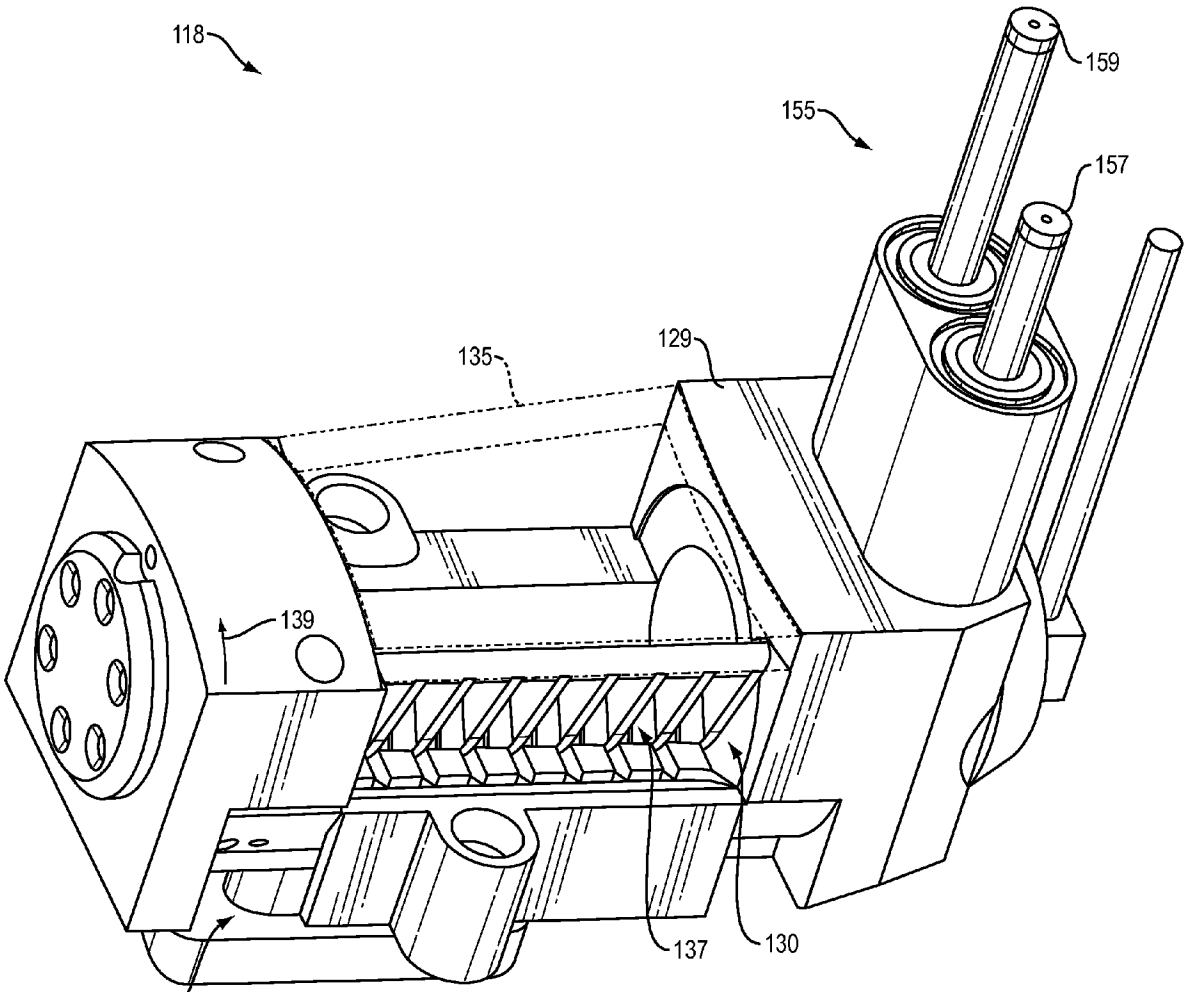
FIG. 4 illustrates a front view of an arrangement of a valve of FIG. 1, according to one arrangement.
Figure 5:
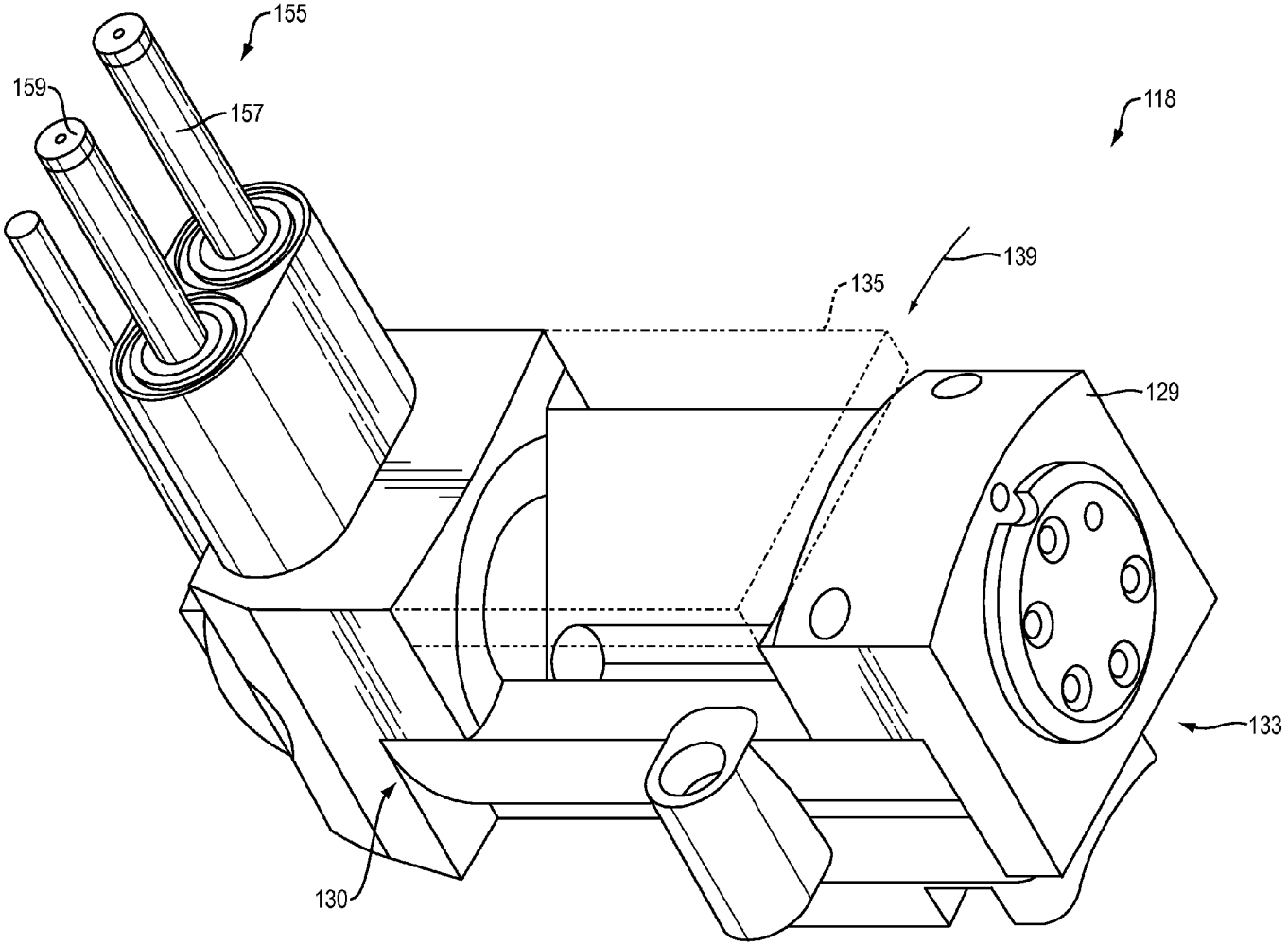
FIG. 5 illustrates a rear view of the valve of FIG. 4, according to one arrangement.
Figure 6:
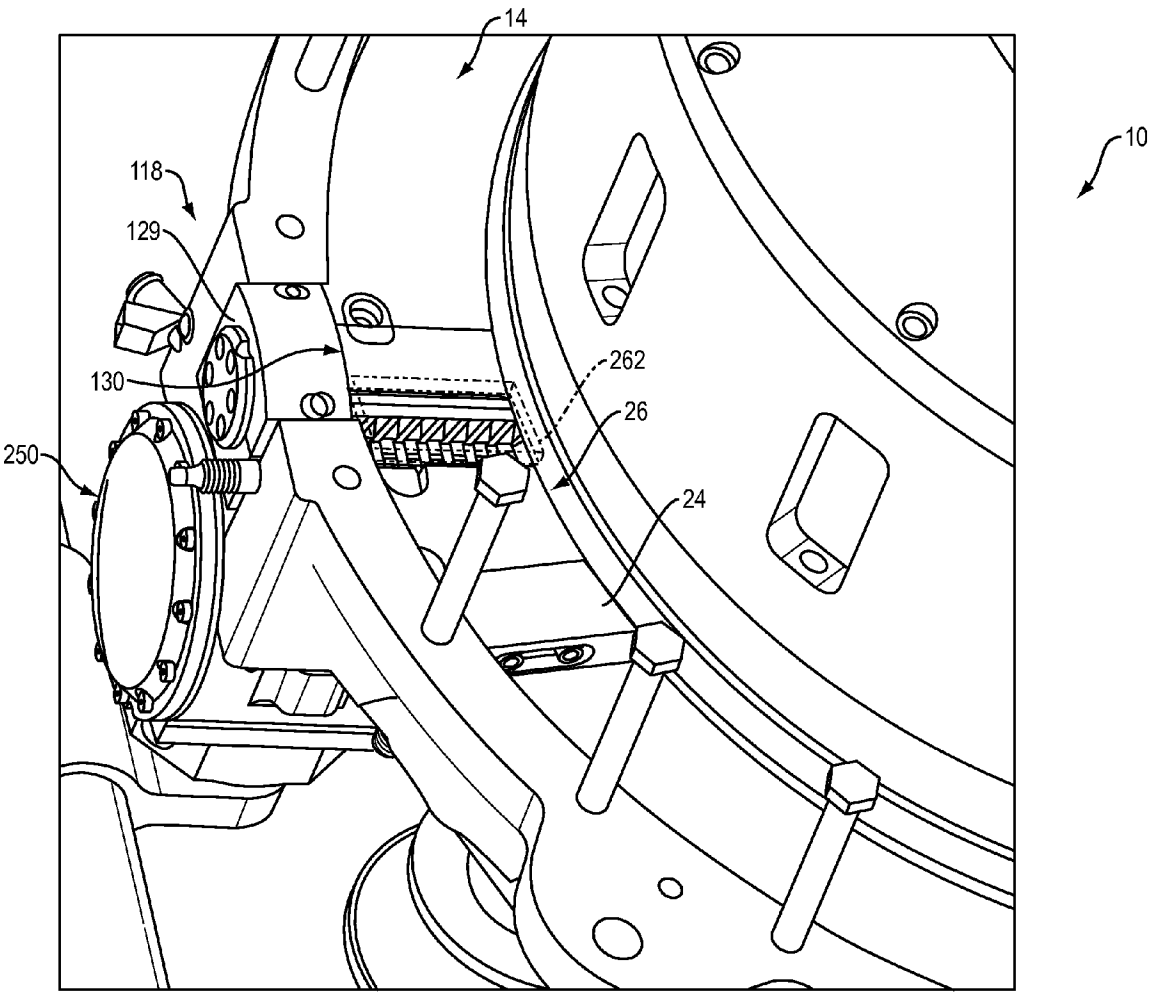
FIG. 6 illustrates the valve of FIG. 4 disposed in an engine, according to one arrangement.

In one arrangement, the valve assembly 118 includes a housing 129 with the valve 130 being rotatably coupled to the housing 129. The valve 130 is configured to pivot within the housing 129 between a first position that allows a piston 24 to travel within the annular bore 14 past the valve 130 and second position that defines the combustion chamber 26 relative to the piston 24. For example, the valve 130 is configured with a notch that defines a channel 135 relative to the annular bore 14 of the housing 10. When the valve 130 is disposed in the first position, as indicated in FIGS. 4 and 5, the channel 135 is configured to allow a piston 24 to travel within the annular bore 14 between a first location proximal to the valve assembly 118 (such as indicated by valve 30-1 relative to piston 24-4 in FIG. 3) and a second location distal to the valve assembly 118. As the valve 130 pivots or rotates within the housing 129 along direction 139, a bulkhead portion 137 of the valve 130 enters the annular bore 14 to define the combustion chamber 26 with the piston 24, as illustrated in FIG. 6.

In one arrangement, a portion of the fuel injector 32 of the engine 10 is integrally formed with the valve 130. For example, with reference to FIGS. 4-6, the housing 129 includes a fuel source port 133 disposed in fluid communication with a set of openings 141 (see FIG. 7A) defined by the valve 130 and with a fuel source and an air source or air intake assembly 250 (see FIGS. 6 and 9A-9C). During operation, the valve 130 is configured to combine fuel from the fuel source and air from the air source 250 into a fuel-air mixture within the combustion chamber 26, as illustrated in FIG. 6.

In one arrangement, the rotation of the valve 130 within the housing 129 can control delivery of the fuel and air from the fuel source port 133 to the set of openings 141 of the valve 130 and, subsequently, to the combustion chamber 26. For example, when the valve 130 is disposed in the first position, as indicated in FIGS. 4 and 5, the set of openings 141 can be aligned with a wall of the housing 129 to fluidly decouple the set of openings 141 from the fuel source port 133. In such an arrangement, the wall housing 129 blocks the delivery of fuel and air from the fuel source and air source 250 to the openings 141. Accordingly, as the piston 24 rotates past the valve 130, the valve 130 cannot deliver fuel or air into the annular bore 14. When the valve 130 rotates to the second position as illustrated in FIG. 6, the set of openings 141 align with and fluidly couple to the fuel source and air source 250 via the fuel source port 133. Accordingly, with such positioning, the valve 130 can direct the fuel and air into the combustion chamber 26 defined between the piston 24 and the valve 130.

Actuation of the valve 130 between the second, closed position to the first, open position utilizes a synchronous actuation mechanism to limit or prevent mechanical contact between the circulating piston 24 and the valve 130 during operation. Conventional engines utilize a cam and cam follower to drive a valve to an open position and a heavy-duty return spring to move the valve to a closed position. The return springs in conventional engines, however, can cause problems due to resonance in the return spring at high operating frequencies. When the operating frequency of the engine matches the natural frequency of the spring, resonance occurs in the spring which can dispose the valve in a position other than the position prescribed by the motion of the cam.

Additionally, resonance can cause a phenomenon known as valve float. In the case of resonant oscillation, the return spring does not have enough stored energy to accelerate the mass of the valve. As a result, the valve effectively floats in a substantially stationary position. Accordingly, as the cam follower leaves and recontacts the cam surface, contact between the cam follower and the cam face generates a contact stress, known as von Mises stress. If the contact stress exceeds the yield strength of the cam surface, gaulling of the cam surface can occur.

Figure 7A:
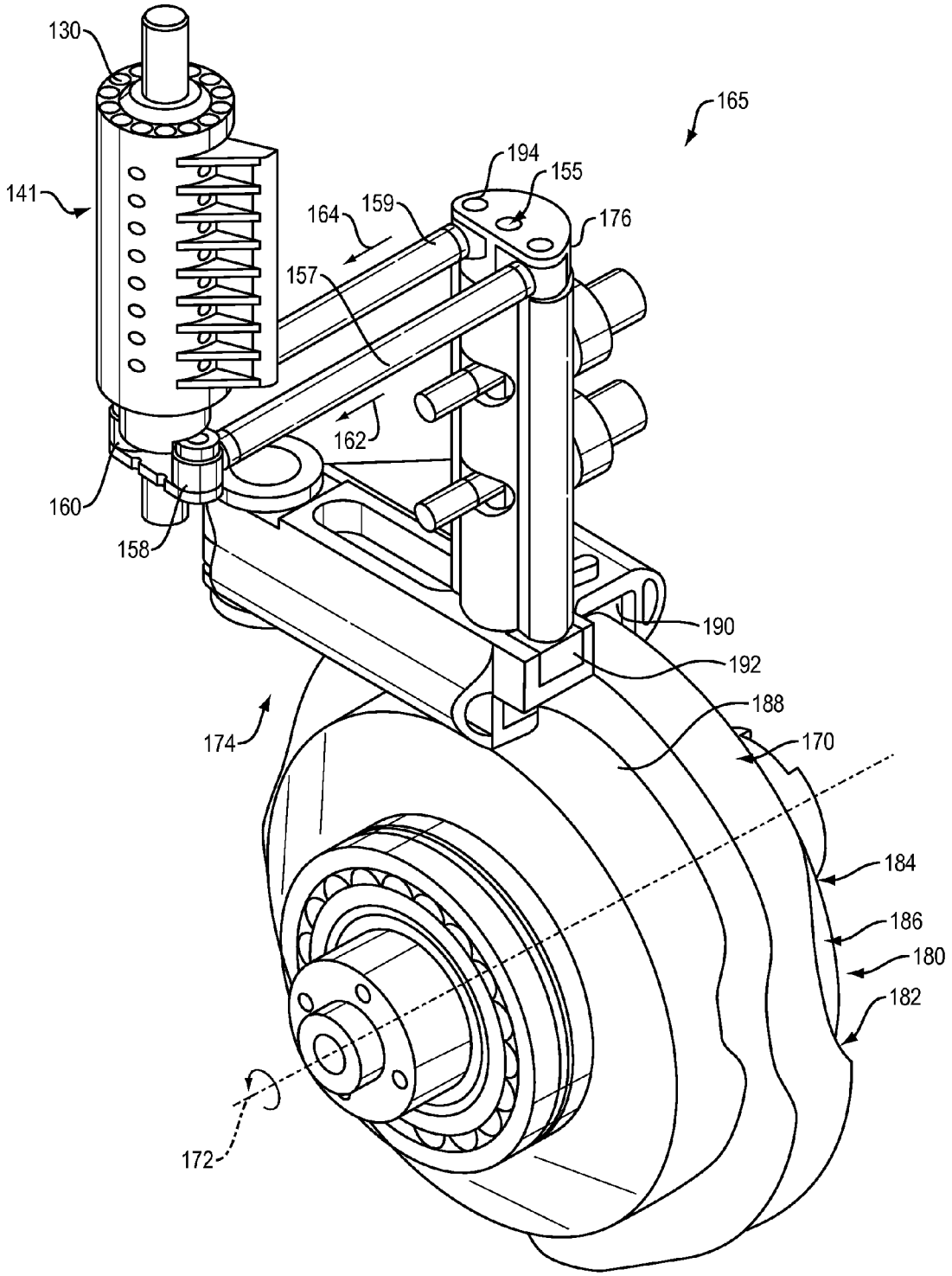
FIG. 7A illustrates an arrangement of a toggling mechanism coupled to the valve of FIG. 4, according to one arrangement.
Figure 7B:
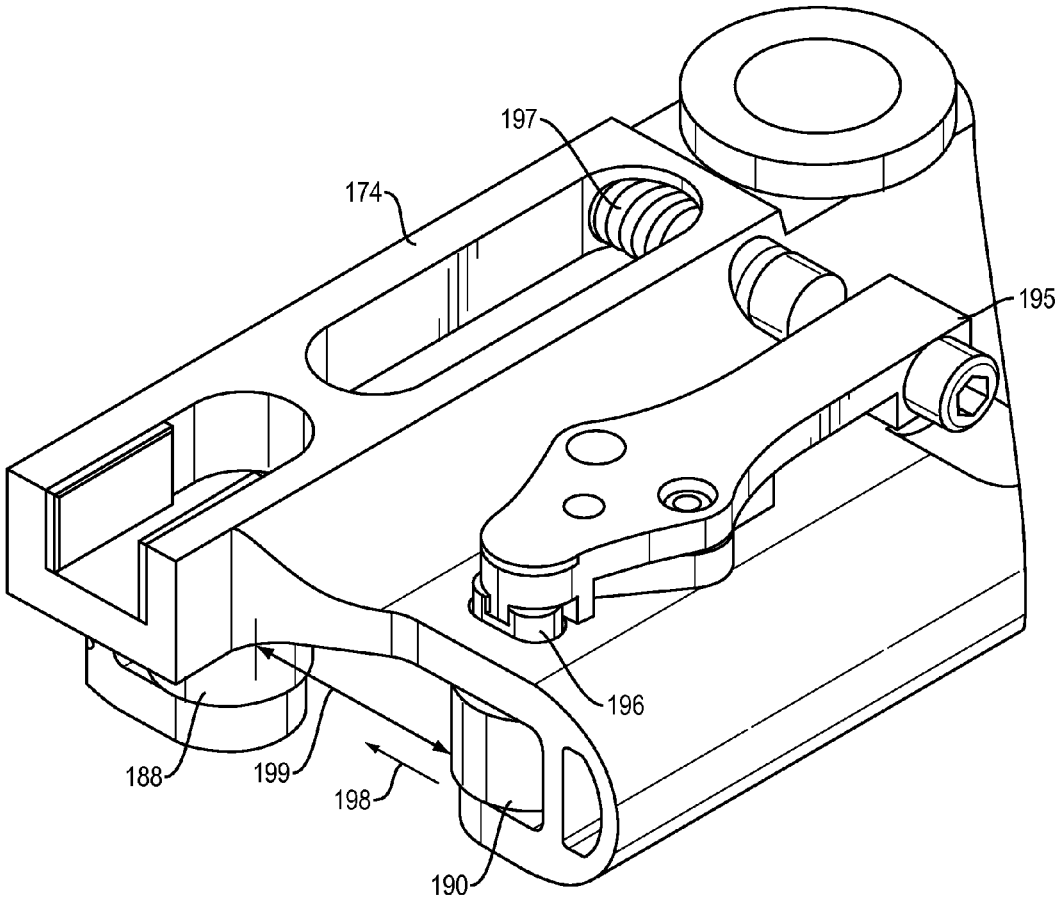
FIG. 7B illustrates a perspective view of a rocker arm of FIG. 7A, according to one arrangement.

While the valve 130 can be actuated within the housing 129 in a variety of ways, in one arrangement, to minimize issues caused by possible resonance of the valve, the valve assembly 118 includes a toggling assembly 155, as shown in FIGS. 4, 5, and 7A, configured to toggle the valve 130 within the housing 129. The toggling assembly 155 is configured to exert positive loads on the valve 130 (i.e., apply a push/push motion on opposing ends of the valve 130) when positioning the valve 130 between the first and second positions. For example, with reference to FIG. 7A, the toggling assembly 155 can include a first arm 157 coupled to a first end 158 of the valve 130 and a second arm 159 coupled to a second end 160 of the valve 130. During operation, the first arm 157 is configured to generate a first, linear, positive load 162 on the first or proximal end 158 of the valve 130 along a positive displacement direction to pivot the valve 130 toward the first position, as illustrated in FIGS. 4 and 5. Further during operation, the second arm 159 is configured to generate a second, linear, positive load 164 on the second or distal end 160 of the valve 130 along the positive displacement direction to pivot the valve 130 toward the second position, as illustrated in FIG. 6.

The toggling assembly 155 can be actuated in a variety of ways. In one arrangement, as illustrated in FIG. 7A, the arms 157, 159 of the toggling assembly 155 are coupled to a cam assembly 165 that includes a barrel cam, such as a conjugate splined barrel cam 170, a rocker arm 174, and a toggle element 176 coupled between the rocker arm 174 and the first and second arms 157, 159.

The conjugate splined barrel cam 170 defines a spline profile 180 for each valve 130. The profile 180 of the cam 170 includes a rise portion 182, a dwell portion 186, and a fall portion 184 which defines the relative movement of the valve 130 during operation. During operation, as the cam rotates about a longitudinal axis 172, the profile 180 imparts an oscillating motion to the valve 130 through the rocker arm 174 and toggle element 176.

The rocker arm 174 is configured to translate the motion of the profile 180 into a reciprocation motion of the toggle element 176. For example, the rocker arm 174 includes a first cam follower 188 and a second cam follower 190, each disposed in proximity to the profile 180 of the cam 170. The rocker arm 174 includes a sliding/pivot joint 192 which actuates the toggle element 176 about longitudinal axis 194 in response to the motion of the rocker arm 174. Because the total angular motion of the toggle element 176 is bisected evenly, when one arm or push rod 157 moves in one direction, the other arm or push rod 159 is displaced by an equal amount in the opposite direction. Cam assembly 165, accordingly, achieves substantially zero backlash during operation when opening and closing the combustion valve 130.

During operation, as the conjugate splined barrel cam 170 rotates about an axis 172, a spline profile or element 180 of the cam 170 actuates the arms 157, 159 to drive the valve 130 between the first and second positions. For example, the cam profile 180 drives the valve 130 to an open position and remains open as the piston 24 passes by and then drives the valve 130 to the closed position when the piston 24 has passed.

In one arrangement, to increase the longevity and lower frictional losses of the toggling assembly 155 and the cam assembly 165, all joints can be configured as roller bearings that can be either pressure lubricated or disposed within an oil bath. In one arrangement, the two cam followers 188, 190 that capture the cam profile 180 are formed from a compliant material to allow for tolerance mismatch in the rocker arm 174, the two cam followers 188, 190, and the relative pivot position of the rocker arm 174 during operation.

Although tolerance could be held to the standards to minimize or prevent backlash, such standardization can add cost to manufacturing process. In one arrangement, to limit the use of tolerance standards, and with reference to FIG. 7B, the second cam follower 190 is secured to an oscillating lever 195 via a diamond-shaped pin 196. The oscillating lever 195, in turn, is coupled to the rocker arm 174 via a spring mechanism 197. The diamond-shaped pin 196 allows relatively small movements of the second cam follower 190 in one direction 198 while maintaining the position of the first cam follower 188. In the application shown in FIG. 7B, the diamond-shaped pin 196 allows a distance 199 between the cam followers 188, 190 to be constantly adjusted by a compressive force, but maintains a radial position of the second cam follower 190 relative to its own pivot point. Accordingly, with the first cam follower 188 and the second cam follower 190 configured to apply a preload force against the spline profile 180, the rocker arm 174 minimizes the use of tolerance standards as part of the cam assembly 165.

The absence of springs in toggle assembly 155 and the cam assembly 165 insures that the valve position is controlled strictly by the cam profile 180 which is important to the functionality of the engine 10 and can limit or prevent any contact between the circulating piston 24 and the valves 130. In the event contact were to occur due to a statistical failure, the valve 130 is designed to move in the same direction as the circulating piston 24 and would most likely be disposed in a closed position in the event of failure.

Conventional engines utilize four stages or cycles to produce power. These cycles include an intake cycle which provides the intake of air and fuel through a system of valves created by piston retraction, a subsequent compression cycle to compress the air and fuel, an ignition/combustion/power cycle, and an exhaust cycle to forcibly exhaust combustion byproducts through a separate valve system. The four stages are performed in a serial fashion by a piston contained within a cylinder of the engine.

In conventional piston engines, the pressure of the hot gasses created by the combustion of the air and fuel mixture contained within the cylinder can create blowby where the hot gasses and their corrosive byproducts are forced past the piston rings into the interior of the engine. As the gasses and byproducts pass into the engine, they can burn a portion of the lubricating oil contained within the cylinder, thereby adding to pollutant creation and corruption of the oil supply. As a result, conventional engines require relatively frequent oil changes. Additionally, conventional piston engines do not allow for relatively high compression ratios because of the resulting knocking/autoignition caused by the relatively long dwell times which can damage the piston and cylinder walls.

Figure 8:
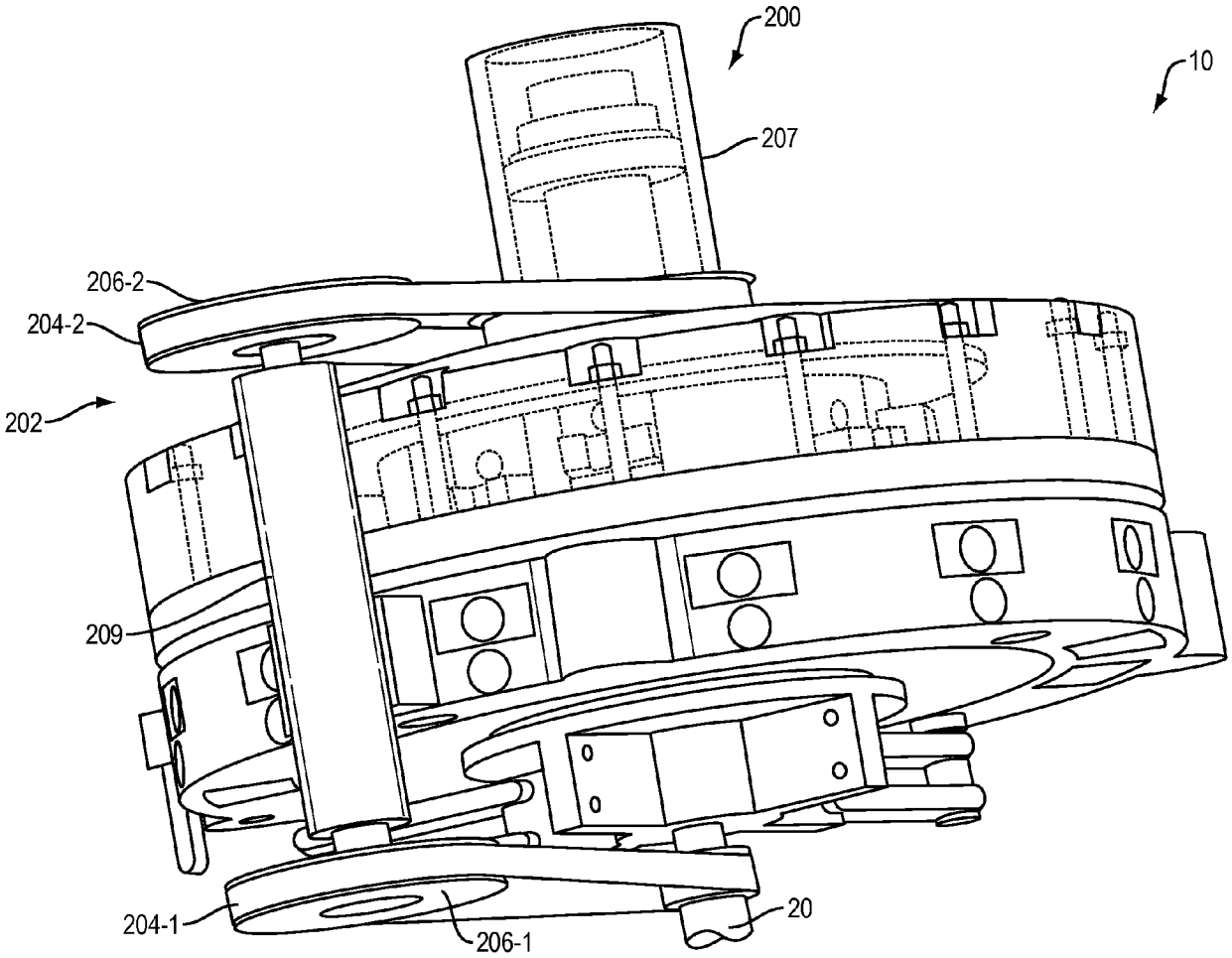
FIG. 8 illustrates an arrangement of a compressor of the engine of FIG. 6.

With reference to FIG. 8, the engine 10 can include a compressor 200 configured to perform an intake cycle to deliver air and fuel into the engine 10 and a compression cycle to compress the air and fuel. The compressor 200 performs these cycles independent from the power and exhaust cycles performed by the valve and piston assemblies 16, 18. By separating the compression process from the combustion process, as found in conventional engines, the compressor 200 allows the engine 10 to start operation with the use of air pressure only. For example, the compressor 200 can be configured to insert compressed air from a reservoir into the combustion chamber 26 between the piston 24 and the closed previous valve 30. Such injection moves the piston 24 to the next point in the annular bore 14 for reignition. To insure the proper location of the piston 24, a small brake can be applied to the flywheel 22 when the engine 10 is turned off to insure proper positioning of the piston 24 for restart. Accordingly, the use of the compressor 200 as part of the engine can minimize or eliminate the need for a starter motor, as found in conventional engines, and can reduce the overall, size, weight, and cost associated with the engine 10.

In one arrangement, the compressor operates synchronously with the engine. For example, the compressor 200 is connected to a drive mechanism 20 powered by the engine 10 through a transmission system 202. The transmission system 202 can be configured as a belt and gear system that includes a set of belts 204-1, 204-2 and corresponding gears 206-1, 206-2. As illustrated, the first belt 204-1 is operatively coupled to the drive mechanism or drive shaft 20 of the engine 10 and to the first gear 206-1, the second belt 204-2 is operatively coupled to the second gear 206-2 and to a compressor shaft 207, and the first gear 206-1 is operatively coupled to the second gear 206-2 via shaft 209. In one arrangement, to cover a speed range of between about 0 to 155 miles per hour (mph), a gear ratio (i.e., including the rear and transmission rears) of between about 1.00:1 (e.g., providing about 60 mph) and 2.57:1 (e.g., providing about 155 mph) can be utilized. Such a configuration can utilize a four-speed transmission with a rear gear ratio of 1:1 and a first gear ration also 1:1. This compares to a conventional drive train having a six-speed transmission of overall ratios of 12.23:1 in first gear (e.g., 30 mph max) to 2.18:1 in sixth gear (e.g., 155 mph max).

The transmission system 202 is configured to alter a ratio of compressor speed to engine speed to control a volume of compressed air generated by the compressor 200 and to control a compression ratio associated with the air and fuel. For example, as the transmission system 202 receives rotational input from the drive shaft 20, the system 202 applies a rotational output on the compressor shaft 207 to rotate the shaft 207 at a rate that is faster than the rotational rate of the drive shaft 20. This produces a high volume of air at a relatively high pressure. Accordingly, the transmission system 202 allows the compressor 200 to operate at a variety of ratios/speeds to optimize performance.

During operation, the compressor 200 generates relatively highly pressurized air which is then mixed with fuel from an injector close to the combustion chamber 26. This allows the input of the air/fuel mix into the combustion chamber 26 at very high pressures, such as pressures of between about 150 and 200 pounds per square inch (psi). Accordingly, the air/fuel mix enters the combustion chamber 26 at a relatively high velocity to create turbulence within the combustion chamber 26 which promotes a mixture of the air and fuel, as well as a short input duration (e.g., as measured in fractions of milliseconds). The high velocity and pressure of the air/fuel mix promote rapid combustion which contributes to the engine's 10 relatively high efficiency.

As indicated above, the compressor 200 is configured to perform two of the four stages or cycles utilized by an engine during operation, separate from the combustion process. Such a configuration allows the circulating pistons 24 in the bore 14 to exclusively perform the third stage (i.e., producing substantially continuous power) during operation. The engine 10 performs the fourth exhaust stage passively with a large, valveless port associated with the bore 14 and open to the air treatment system and atmosphere. When combustion and expansion is complete, the piston 24 passes the exhaust opening 38 and the spent gas within the chamber 26 is expelled from the engine. The compressor 200 is physically and thermally isolated from the combustion process. Accordingly, the compressor 200 does not experience blowby which, in conventional piston engines relates to the passage of combusted gases past the piston rings and into a crankcase. Traditional blowby causes the engine to accumulate contaminated exhaust gas that requires treatment before exhausted to the atmosphere. In addition, in conventional piston engines, the mixing of contaminated exhaust gases with the oil stored in the case significantly shortens the oil life causing more frequent oil changes. This oil itself must be treated before disposal or reuse.

Figure 9A:
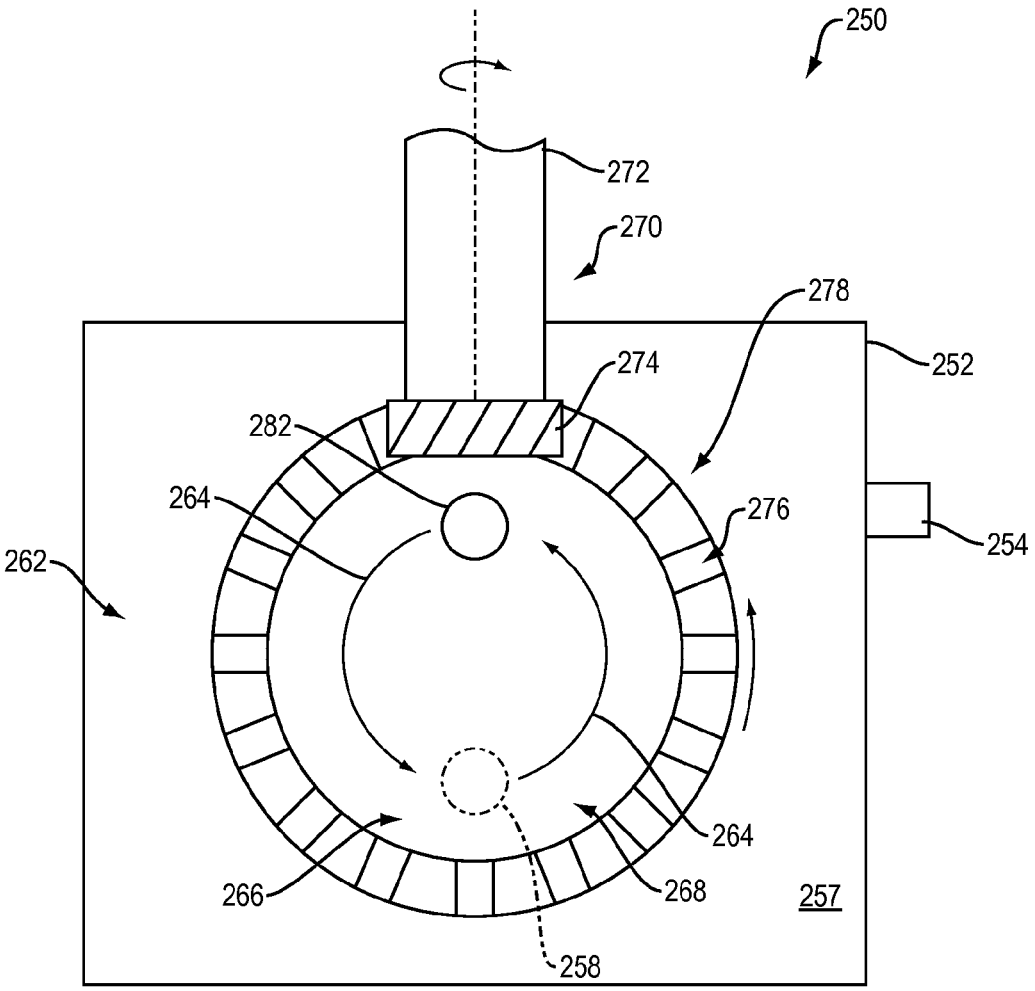
FIG. 9A illustrates a top schematic view of an air intake assembly, according to one arrangement.
Figure 9B:
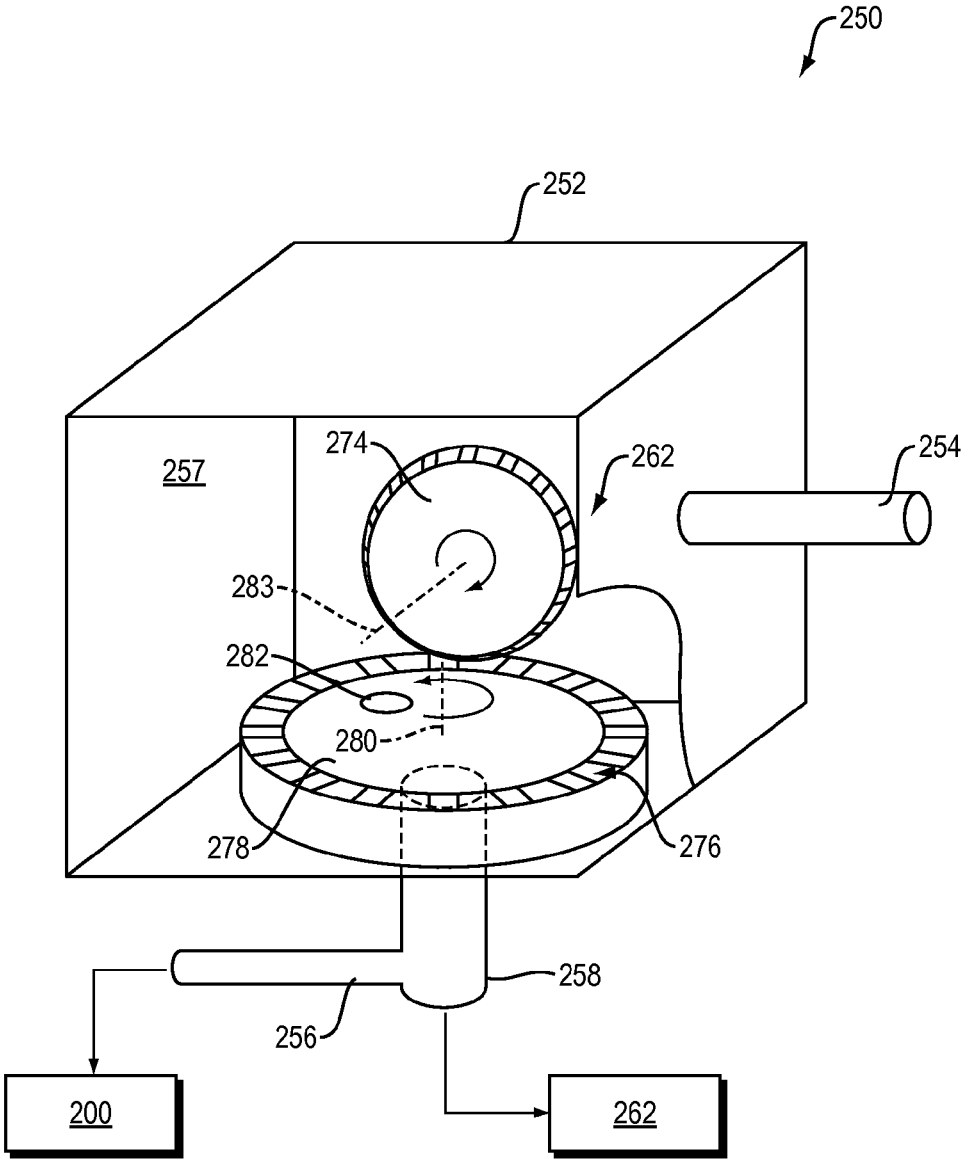
FIG. 9B illustrates a perspective cutaway view of a rotatable plate of the air intake assembly of FIG. 9A.
Figure 9C:
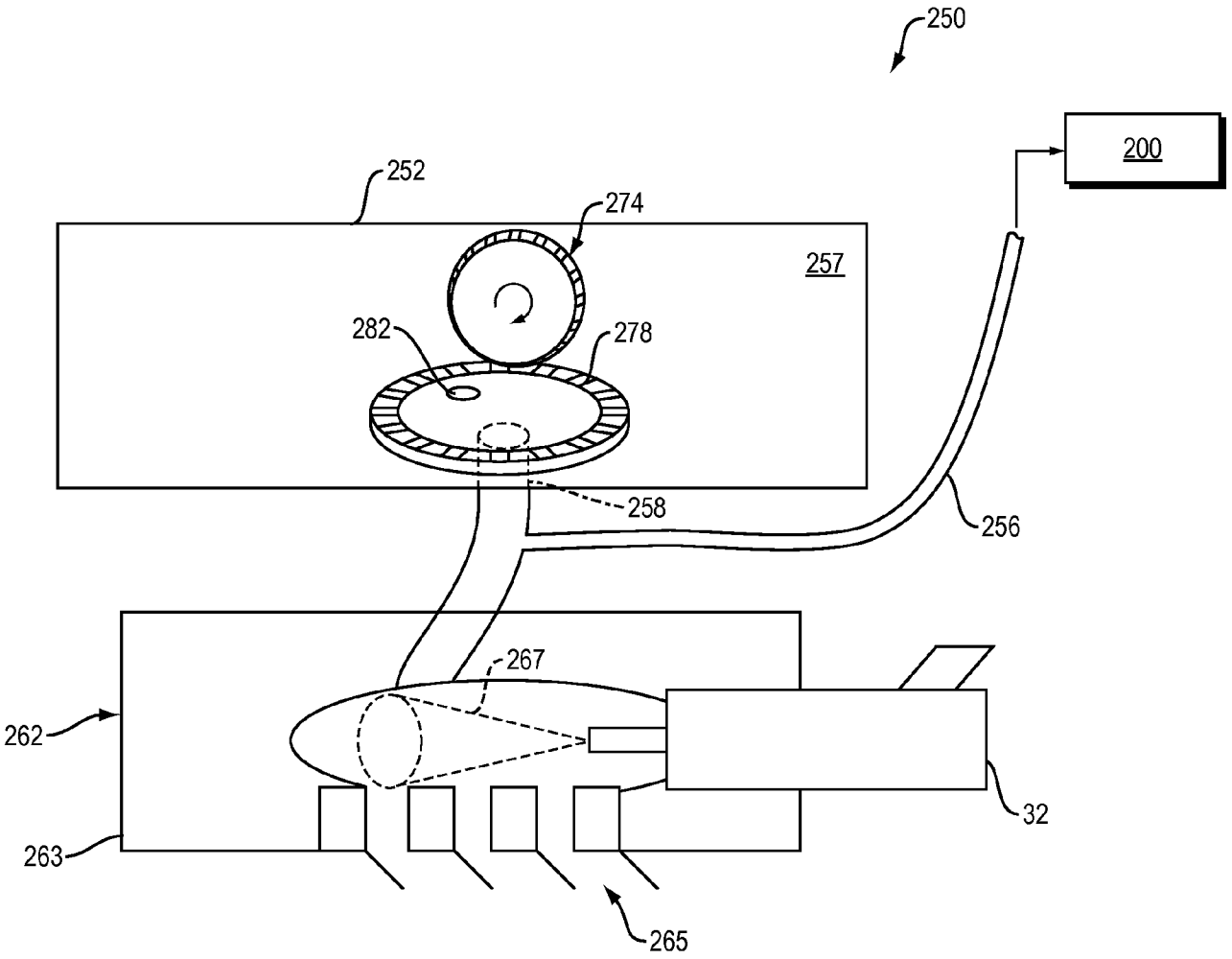
FIG. 9C illustrates a schematic view of the air intake assembly and a fuel distribution assembly of FIG. 9B.

With reference to FIG. 6, and as indicated above, valve 130 is configured to input the fuel-air mix from a fuel distribution assembly 262 close to the combustion chamber 26. FIGS. 9A through 9C illustrate an example schematic representation of an air intake assembly 250 and fuel distribution assembly 262.

As illustrated, the air intake assembly 250 includes a housing 252 having an air intake port 254 and an air output port 258. The air intake port 254 is configured to receive air from an air source, such as a high pressure air source. The air output port 258 is selectively disposed in fluid communication between the housing volume 257 and the fuel distribution assembly 262.

The air intake assembly 250 further includes a drive assembly 270 that is configured to provide selectable communication between the air output port 258 and the interior volume 257 of the housing 252. For example, the drive assembly 270 includes a shaft 272 disposed in operational communication with the engine 10 and gear 274, such as a worm gear, disposed at an end of the shaft 272 and a plate 278 that is rotatably coupled to the housing 252. The gear 274 is disposed in operational communication with a corresponding set of teeth 276 disposed about an outer periphery of the plate 278. The plate 278 is configured to rotate about a longitudinal axis 280 within the housing 252 in response to axial rotation of the drive assembly 270. For example, during operation, rotation of the shaft 272 and the gear 274 about longitudinal axis 282 in a clockwise direction causes the plate 278 to rotate within the housing 252 in a counterclockwise direction about longitudinal axis 280 within the housing 252. Additionally, the plate 278 defines an aperture 282 that is configured to selectively allow fluid communication between the port 258 and the housing volume 257, as described in detail below.

With reference to FIG. 9C, located in proximity to the air intake assembly 250 is the fuel distribution assembly 262. The fuel distribution assembly 262 is configured to allow mixing of the fuel and air within the assembly housing 263. Attached to the housing 263 is at least one fuel injector 32.

During operation, the plate 278 disposes the aperture 282 along a rotational path 264, as indicated in FIG. 9A. As the plate 278 rotates along a counterclockwise direction toward the output port 258, the plate 278 positions the aperture 282 along the path 264. With such positioning, the plate 278 blocks output port 258 and from the housing volume 257 to minimize or prevent fluid communication there between. Accordingly, the housing volume 257 can receive relatively high pressure air via the air intake port 254.

As the aperture 282 approaches a first open position 266, the fuel injector 32 injects fuel into the housing 263 of the fuel distribution assembly 262. As the plate 278 continues to rotate along the counterclockwise direction, the plate 278 disposes the aperture 282 in a first open position 266 which aligns the aperture 282 with the air output port 258. With such positioning, immediately following fuel injection, compressed air from assembly 250 is transported through port 258 of assembly 250 and into the fuel distribution assembly 262 to mixes the air with the suspended fuel 267. This mixture then flows through flexure valves 265 and into openings 141 of the valve 130, as indicted in FIG. 6. A bleed line 256 attached to an intake system of the compressor 200 draws excess air, reducing the high pressure in assembly 262 permitting operation of the fuel injector 32 for the next cycle which operates at lower pressure.

Following the delivery of the air to the fuel distribution assembly 262, the plate 278 rotates the aperture 282 counterclockwise past the air output port 258 to allow introduction of pressurized air into the volume 257 for a subsequent fuel distribution cycle.

While various embodiments of the innovation have been particularly shown and described, it will be understood by those skilled in the art that various changes in form and details may be made therein without departing from the spirit and scope of the innovation as defined by the appended claims.

For example, as described above, the piston assembly includes four pistons and the valve assembly includes four valves. Such description is by way of example only. In one arrangement, the piston assembly can include a first piston and a second piston, the first piston disposed within the annular bore at a position that is substantially 180° from the second piston. Additionally, the valve assembly can include a first valve disposed at a first location within the housing and a second valve disposed at a second location within the housing, the second valve being disposed along the annular bore at a position that is substantially 180° relative to the first valve.

As indicated above, the valve assembly 118 includes a toggling assembly 155, as shown in FIGS. 4, 5, and 7A, configured to toggle the valve 130 within the housing 129. As described, the arms 157, 159 of the toggling assembly 155 are coupled to a cam assembly 165 that includes a barrel cam, such as a conjugate splined barrel cam 170, a rocker arm 174, and a toggle element 176 coupled between the rocker arm 174 and the first and second arms 157, 159. During operation, the first arm 157 is configured to generate a first, positive load 162 on the first end 158 of the valve 130 along a positive displacement direction to pivot the valve 130 toward the first position and the second arm 159 is configured to generate a second, positive load 164 on the second end 160 of the valve 130 along the positive displacement direction to pivot the valve 130 toward the second position. Such description is by way of example only. In one arrangement, the toggling assembly is configured with a reduced number of moving parts that extends a connection between the valve 130 and the cam 170 along an axis of rotation of the valve 130.

Figure 10:
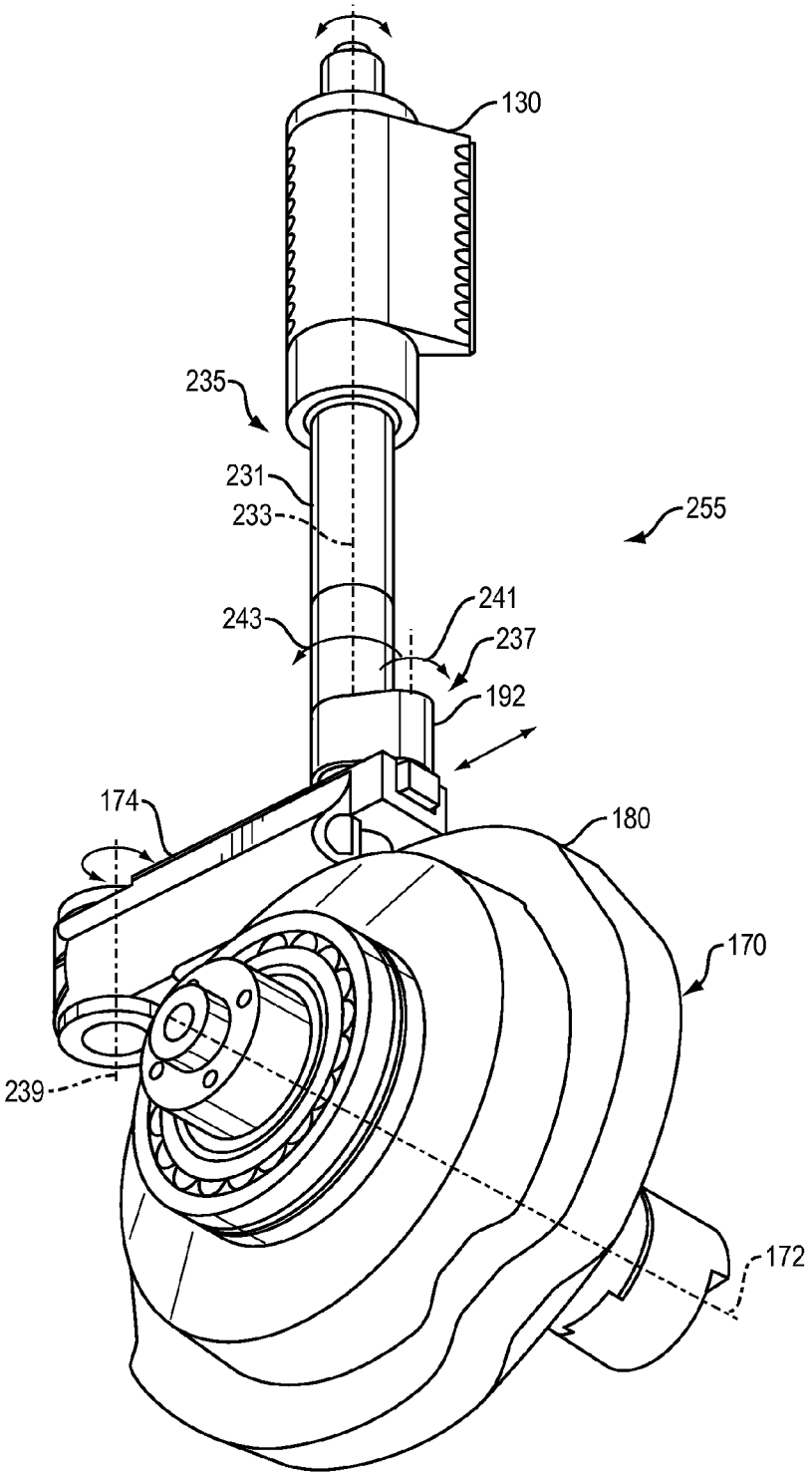
FIG. 10 illustrates a perspective view of a rocker arm disposed between a valve and a splined barrel cam.

For example, with reference to FIG. 10, the toggling assembly 255 includes a valve support 231 extending along a longitudinal axis 233 of the valve 130 between the valve 130 and the rocker arm 174. A first end 235 of the valve support 231 is coupled to the valve 130 while a second end of the valve support 237 is slidably coupled to the rocker arm 170 via a sliding/pivot joint 192. While the valve support 231 can be configured in a variety of ways, in one arrangement, the valve support 231 is configured as a substantially cylindrical, tubular structure.

During operation, as the conjugate splined barrel cam 170 rotates about the axis 172, the spline profile or element 180 of the cam 170 oscillates the rocker arm 174 in both a clockwise and counterclockwise direction about an axis of rotation 239. In response to the oscillation of the rocker arm 174, the sliding/pivot joint 192 exerts a first rotational load 241 and an opposing second rotational load 243 on the valve support 231 to oscillate the valve support 231 and the valve 130 about longitudinal axis 233. Such oscillation positions the valve 130 between a first (e.g., open) position and a second (i.e., closed) position within the valve housing.

Use of the valve support 231 provides the toggling assembly 255 with a relatively low moment of inertia which, in turn, allows the rocker arm 174 to toggle the valve 130 within the valve housing at a relatively high speed. Additionally, because the valve support 231 has relatively few parts, the valve support 231 reduces the possibility of the toggling assembly 255 failing during operation.

Furthermore, the valve support 231 provides the toggling assembly 255 with a relatively long life. For example, during operation as the piston 24 approaches the valve 130, the valve 130 must move to an open position (i.e., out of the piston's path) and then back to a closed position in a relatively short amount of time. Once the toggle assembly 255 moves the valve 130 to a closed position, the valve 130 defines a combustion chamber relative to the piston 24 and the gas pressure within the chamber builds at a relatively high rate. The gas pressure within the combustion chamber creates not only a force that propels the piston 24 forward, but an equal and opposite force on the valve 130 itself. With the configuration of the valve support 231 as a substantially cylindrical, tubular structure, the valve support 231 has a relatively large stiffness which increases the overall stiffness of the valve assembly and minimizes failure.

As indicated above, each valve 30 of the valve assembly 18 is moveably disposed within an annular bore to create a temporary combustion chamber 26 relative to a corresponding piston 24. For example, with reference to FIG. 2B, when the piston 24-1 reaches a given location within the annular bore 14, the valve 30-1 moves to a second position relative to the annular bore 14. With such positioning, the valve 30-1 forms the combustion chamber 26-1 relative to the piston 24-1 and is configured as a bulkhead against which combustion can work to produce power. In one arrangement, the size of the combustion chamber 26 can be altered during operation to adjust the power output or efficiency of the engine. For example, the volume of the combustion chamber 26 can be decreased or increased by varying the duration of the fuel input process to the combustion chamber 26 and by adjusting (e.g., delaying) the ignition timing accordingly. In the case where the volume of the combustion chamber 26 is increased, the engine can include a second spark plug (not shown) located adjacent to the relatively larger combustion chamber 26 to accelerate combustion in the enlarged chamber.

It should be noted that the walls of the combustion chamber 26 and the direction of introduction of fuel relative to the valve can be modified to create a variety of geometric travel paths for the air/fuel mixture. For example, the walls of the combustion chamber 26 and the direction of fuel introduction can define a circular or other geometry to accelerate ignition and combustion effectiveness.

As indicated above, in order to control the power and output torque of the engine 10 as necessary, the engine 10 can fire anywhere from one to sixteen times per revolution. In one arrangement, the engine 10 can be configured to alternate the firing order of the combustion chambers 26 to reduce the operating temperature of the engine 10. For example, with reference to FIG. 1, in the case where the engine 10 has accelerated to a particular drive mechanism 20 velocity, the engine 10 can require firing of only two combustion chambers 26 during a revolution of the piston assembly 30 within the engine 10 to maintain the velocity. To minimize the engine temperature, in a first revolution cycle, the first 26-1 and third 26-3 combustion chambers can be fired while in a second revolution cycle, the second 26-2 and fourth 26-4 combustion chambers can be fired. When certain combustion chambers 26 are not fired, relatively low temperature air flows through those combustion chambers as well through the annular bore 12, thereby reducing the operating temperature of the engine 10. This allows a leaner fuel-air mixture to be utilized during operation to improve engine efficiency and air quality.

What is claimed is:

1. An engine, comprising:

a housing defining an annular bore;

an air intake assembly including an air intake port and an air outlet port provided on the housing;

a fuel distribution assembly;

an exhaust gas port;

a piston assembly disposed within the annular bore, the piston assembly configured to be coupled to a drive mechanism;

a valve configured to oscillate between a first position within the annular bore to allow the piston assembly to travel within the annular bore from a first location proximate to the valve to a second location distal to the valve and a second position within the annular bore to define a combustion chamber relative to the piston assembly at the second location; and a cam assembly, comprising:

a conjugate splined barrel cam defining a spline profile about an outer periphery of the conjugate splined barrel cam, the conjugate splined barrel cam configured to rotate the spline profile about an axis of rotation;

a rocker arm having a cam follower disposed in proximity to the spline profile of the conjugate splined barrel cam, the rocker arm configured to rotate about a pivot joint in response to rotation of the spline profile of the conjugate splined barrel cam about the axis of rotation; and a toggling assembly disposed between the rocker arm and the valve, the toggling assembly configured to oscillate the valve between the first position and the second position in response to rotation of the rocker arm about the pivot joint.

2. The engine of claim 1, wherein:

the piston assembly comprises a first piston and a second piston, the first piston disposed within the annular bore at a position that is substantially 180° from the second piston; and the valve comprises a first valve disposed at a first location within the housing and a second valve disposed at a second location within the housing, the second valve being disposed along the annular bore at a position that is substantially 180° relative to the first valve.

3. The engine of claim 1, wherein:

the piston assembly comprises a first piston, a second piston, a third piston, and a fourth piston, each of the first piston, the second piston, the third piston, and the fourth piston disposed consecutively within the annular bore such that each piston is disposed within the annular bore at substantially 90° relative to a previous disposed piston; and the valve comprises a first valve disposed at a first location within the annular bore, a second valve disposed at a second location within the annular bore, a third valve disposed at a third location within the annular bore, and a fourth valve disposed at a fourth location within the annular bore, each of the first valve, second valve, third valve, and fourth valve being disposed consecutively within the housing and along the annular bore at a position that is substantially 90° relative to a previous valve.

4. The engine of claim 1, wherein the valve defines a set of openings, the valve configured to move between (i) a first position to fluidly decouple the set of openings relative to the fuel distribution assembly, the fuel distribution assembly configured to mix fuel from a fuel source and air from an air source within an assembly housing and (ii) a second position to fluidly couple the set of openings with the fuel distribution assembly to direct a fuel and air mixture into the combustion chamber defined between the piston assembly and the valve.

5. The engine of claim 1, wherein the valve defines a channel, the channel configured to define, in conjunction with the housing, a passageway that allows the piston assembly to travel within the annular bore from the first location proximate to the valve to the second location distal to the valve when the valve is disposed in the first position.

6. The engine of claim 1, wherein the toggling mechanism comprises a first arm coupled to the valve and a second arm coupled to the valve, the first arm of the toggling mechanism configured to generate a first linear load on the valve along a displacement direction to pivot the valve in a first direction toward the first position and the second arm of the toggling mechanism configured to generate a second linear load on the valve along the displacement direction to pivot the valve in a second direction toward the second position.

7. The engine of claim 6, wherein the conjugate splined barrel cam is configured to drive the rocker arm to generate the first linear load along the displacement direction and the second linear load along the displacement direction.

8. The engine of claim 1, wherein the toggling mechanism comprises a valve support extending along a longitudinal axis of the valve between the valve and the rocker arm, the valve support configured to generate a rotational load on the valve to oscillate the valve between the first position and the second position.

9. The engine of claim 1, further comprising a compressor configured to perform an intake cycle to deliver air and fuel to the engine and to perform a compression cycle to compress the air and fuel in the engine, the intake cycle and the compression cycle separate from a combustion process associated with the piston assembly and valve assembly.

10. The engine of claim 9, comprising a belt and gear system coupled to the compressor, the belt and gear system configured to adjust a ratio of compressor speed to engine speed to control a volume of compressed air generated by the compressor and a compression ratio associated with the air and fuel.

11. The engine of claim 10, wherein the belt and gear system comprises:

a first belt operatively coupled to the drive mechanism and to a first gear;

a second belt operatively coupled to a second gear and to a compressor shaft; and a shaft operatively coupled to the first gear and to the second gear.

12. The engine of claim 1, comprising an exhaust port disposed in fluid communication with the annular bore, the exhaust port disposed at a location substantially proximal to the valve.

13. The engine of claim 4, wherein:

the air intake assembly comprises:

an air intake assembly housing provided on the housing and defining a housing volume, the air intake port provided on the air intake assembly housing, the air outlet port provided on the air intake assembly housing and disposed in fluid communication with a compressor, and the drive assembly provided on the air intake assembly housing, the drive assembly configured to provide selectable communication between the housing volume and the air outlet port; and the fuel distribution assembly having a fuel distribution assembly housing defining a fuel distribution assembly housing volume disposed in fluid communication with the air outlet port of the air intake assembly, the fuel distribution assembly comprising:

a fuel injector configured to provide fuel to the fuel distribution assembly housing volume, the fuel distribution assembly housing volume configured to receive compressed air from the air outlet port of the air intake assembly following injection of fuel by the fuel injector, and a set of flexure ports disposed in fluid communication with the valve, the set of flexure ports configured to deliver the fuel and air mixture to the valve.

14. The engine of claim 13, wherein the drive assembly comprises a plate that is rotatably coupled to the housing and is configured to selectively align an aperture defined by the plate with the air outlet port to provide fluid communication the air outlet port and the fuel distribution assembly.

15. The engine of claim 13, wherein the valve is configured to provide the fuel and air mixture to the combustion chamber over a time duration of less than one millisecond.

16. The engine of claim 1, wherein:

the annular bore, defined by the housing, defines a substantially rectangular cross-sectional area;

the piston defines a substantially rectangular cross-sectional area relative to the annular bore; and the valve defines a substantially rectangular cross-sectional area relative to the annular bore.

17. The engine of claim 1, wherein the spline profile comprises a rise portion, a dwell portion, and a fall portion.

18. The engine of claim 9, wherein a compressor shaft of the compressor is connected to a drive mechanism of the engine by a transmission system, the transmission system configured to receive rotational input from the drive mechanism and to apply a rotational output on the compressor shaft to rotate the compressor shaft at a rate that is faster than a rotational rate of the drive shaft.

19. The engine of claim 17, wherein the rise portion, dwell portion, and fall portion of the conjugate splined barrel cam are disposed about the outer periphery along a direction that is perpendicular to a planar face of the cam.

* * * * *